US008727294B1

(12) United States Patent
Harms

(10) Patent No.: US 8,727,294 B1
(45) Date of Patent: May 20, 2014

(54) HANDGUN HOLDING SYSTEM

(76) Inventor: Thomas C. Harms, Mount Dora, FL (US)

( * ) Notice: Subject to any disclaimer, the term of this patent is extended or adjusted under 35 U.S.C. 154(b) by 261 days.

(21) Appl. No.: 13/210,039

(22) Filed: Aug. 15, 2011

Related U.S. Application Data

(63) Continuation-in-part of application No. 12/751,939, filed on Mar. 31, 2010, now abandoned.

(51) Int. Cl.
*F41C 33/00* (2006.01)
*F41C 33/02* (2006.01)

(52) U.S. Cl.
USPC ..... 248/346.01; 211/64; 206/317; 224/912; 224/192; 224/193; 224/198; 224/238; 224/243; 89/37.04

(58) Field of Classification Search
USPC ..... 248/346.01, 209.1, 297.2; 211/64; 206/317; 224/912, 192, 193, 198, 238, 224/243; 89/37.04
See application file for complete search history.

(56) References Cited

U.S. PATENT DOCUMENTS

| | | | | |
|---|---|---|---|---|
| 3,419,728 | A | 12/1968 | Wilson | |
| 3,796,358 | A | 3/1974 | Grubb | |
| 4,466,537 | A | 8/1984 | McMahan | |
| 5,168,994 | A * | 12/1992 | Beletsky et al. | 206/317 |
| 5,451,023 | A | 9/1995 | Johnston | |
| 5,467,909 | A | 11/1995 | Resca et al. | |
| 5,503,276 | A | 4/1996 | Pierce | |
| D370,408 | S | 6/1996 | Van Dyke | |
| 5,579,923 | A | 12/1996 | Hemmerlein | |
| 5,806,739 | A * | 9/1998 | Wood | 224/555 |
| 5,806,909 | A | 9/1998 | Wise | |
| 6,017,085 | A | 1/2000 | LaCroix et al. | |
| 6,523,374 | B1 | 2/2003 | Owens | |
| 6,585,209 | B1 | 7/2003 | Mattingly | |
| 6,843,081 | B1 | 1/2005 | Painter | |
| 2003/0057122 | A1 | 3/2003 | Bushnell et al. | |
| 2006/0113261 | A1 | 6/2006 | Recknagel et al. | |
| 2007/0241010 | A1 | 10/2007 | Giebel et al. | |
| 2012/0255979 | A1 * | 10/2012 | Sitz | 224/243 |

* cited by examiner

*Primary Examiner* — Terrell McKinnon
*Assistant Examiner* — Christopher Garft

(57) ABSTRACT

A handgun holding system featuring a base plate with a pair of slots, each slot has a bracket that can slide and rotate within its respective slot. The first bracket has a spring clip for temporarily engaging the grip portion of a handgun, and the second bracket has a boot with an inner magnet for temporarily engaging the barrel of the handgun. The base plate can be mounted to a surface via a mounting means.

1 Claim, 9 Drawing Sheets

EXPLODED SIDE VIEW

ALT. EMBODIMENT (ROLLERS)

ALT. EMBODIMENT (MAGNET)

HANDGUN HOLDING SYSTEM

CROSS REFERENCE

This application is a continuation-in-part of U.S. patent application Ser. No. 12/751,939 filed Mar. 31, 2010, the disclosure of which is incorporated herein by reference in its entirety.

FIELD OF THE INVENTION

The present invention is directed to a system for temporarily holding a handgun or other firearm.

BACKGROUND OF THE INVENTION

In the event of an emergency, a handgun may be either inaccessible or require latches to be released. This requires time, which in emergency situations is very valuable. The present invention features a handgun holding system for providing hidden storage of and quick accesses to a handgun. The system of the present invention can be mounted to various places, for example under a table or counter, under a desk in a drawer, etc. The system is adjustable to accommodate any sized handgun.

SUMMARY

The present invention features a handgun holding system. In some embodiments, the system comprises a base plate having a top surface and a bottom surface; a first slot and a second slot each disposed in the base plate; a first bracket extending upwardly from the top surface of the base plate, the first bracket comprises a first base portion that engages the base plate and a first gun portion; a second bracket extending upwardly from the top surface of the base plate, the second bracket comprises a second base portion that engages the base plate and a second gun portion; a first thumbscrew penetrating the first base portion of the first bracket and penetrating the first slot, the first thumbscrew can slide and rotate within the first slot to move and rotate the first bracket with respect to the base plate; a second thumbscrew penetrating the second base portion of the second bracket and penetrating the second slot, the second thumbscrew can slide and rotate within the second slot to move and rotate the second bracket with respect to the base plate; a first counterbore slot disposed in the bottom surface of the base plate in line with the first slot and a second counterbore slot disposed in the bottom surface of the base plate in line with the second slot; a first screw lock plate slidably disposed in the first counterbore slot, and a second screw lock plate slidably disposed in the second counterbore slot, wherein an outer end of the first thumbscrew engages the first screw lock plate and an outer end of the second thumbscrew engages the second screw lock plate, the first thumbscrew and the second thumbscrew can be rotated in a first direction or a second direction to respectively allow and prevent movement or rotation of the first bracket and second bracket, respectively; and grip engagement device for temporarily gripping a grip portion of a handgun disposed on the first gun portion of the first bracket. The system further comprises a barrel engagement device for temporarily engaging a barrel of a handgun. The barrel engagement device is disposed on the second gun portion of the second bracket.

In some embodiments, the barrel engagement device comprises a boot having an open end, a bracket end, and an inner cavity, the bracket end is attached to the second gun portion of the second bracket, the inner cavity is adapted to accept a barrel of a handgun, wherein a boot magnet is disposed on an inner surface of the bracket end of the boot, the boot magnet is adapted to temporarily attach to the barrel of the handgun when the barrel is engaged in the inner cavity of the boot. In some embodiments, a bracket slot is disposed in the second gun portion of the second bracket, wherein a boot screw penetrates the bracket slot, a first end of the boot screw engages the boot and a second end of the boot screw engages a nut, the boot screw can slide and rotate within the bracket slot allowing the boot to move with respect to the second bracket and allowing the boot to move upwardly and downwardly with respect to the top surface of the base plate.

In some embodiments, the barrel engagement device comprises a pair of spring arms pivotally attached to the second gun portion of the second bracket, the spring arms are adapted to snugly hug a barrel of a handgun, the spring arms can move between at least an engaged position and a disengaged position, wherein in the engaged position the spring arms hug the barrel of the handgun and in the disengaged position the spring arms are pivoted away from the barrel of the handgun. In some embodiments, the system further comprises a roller disposed on an outer end of each spring arm.

In some embodiments, the barrel engagement device comprises a stud disposed on the second gun portion of the second bracket, wherein the stud engages the inner channel of the barrel of the handgun. In some embodiments, stud is cylindrical. In some embodiments, stud is removably mounted in a stud slot disposed in the second gun portion of the second bracket. In some embodiments, barrel engagement device comprises a barrel magnet disposed on the second gun portion of the second bracket.

In some embodiments, the first slot is perpendicular to the second slot. In some embodiments, an angle formed between the first slot and the second slot is between about 45 to 135 degrees. In some embodiments, the first bracket or the second bracket is L-shaped. In some embodiments, the grip engagement device comprises a spring clip.

In some embodiments, the system further comprises a mounting means for mounting the base plate to a surface. In some embodiments, the mounting means comprises mounting apertures disposed in the base plate. In some embodiments, the mounting means comprises an adhesive mechanism, a bracket mechanism, a tie mechanism, a snap mechanism, a look-and-loop fastener mechanism, a magnet mechanism, or a combination thereof.

In some embodiments, the system further comprises a third slot disposed in the base plate, wherein a third counterbore slot is disposed in the bottom surface of the base plate in line with the third slot, the third slot is adapted to receive the first thumbscrew and the third counterbore slot is adapted to receive the first screw lock plate.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 6:
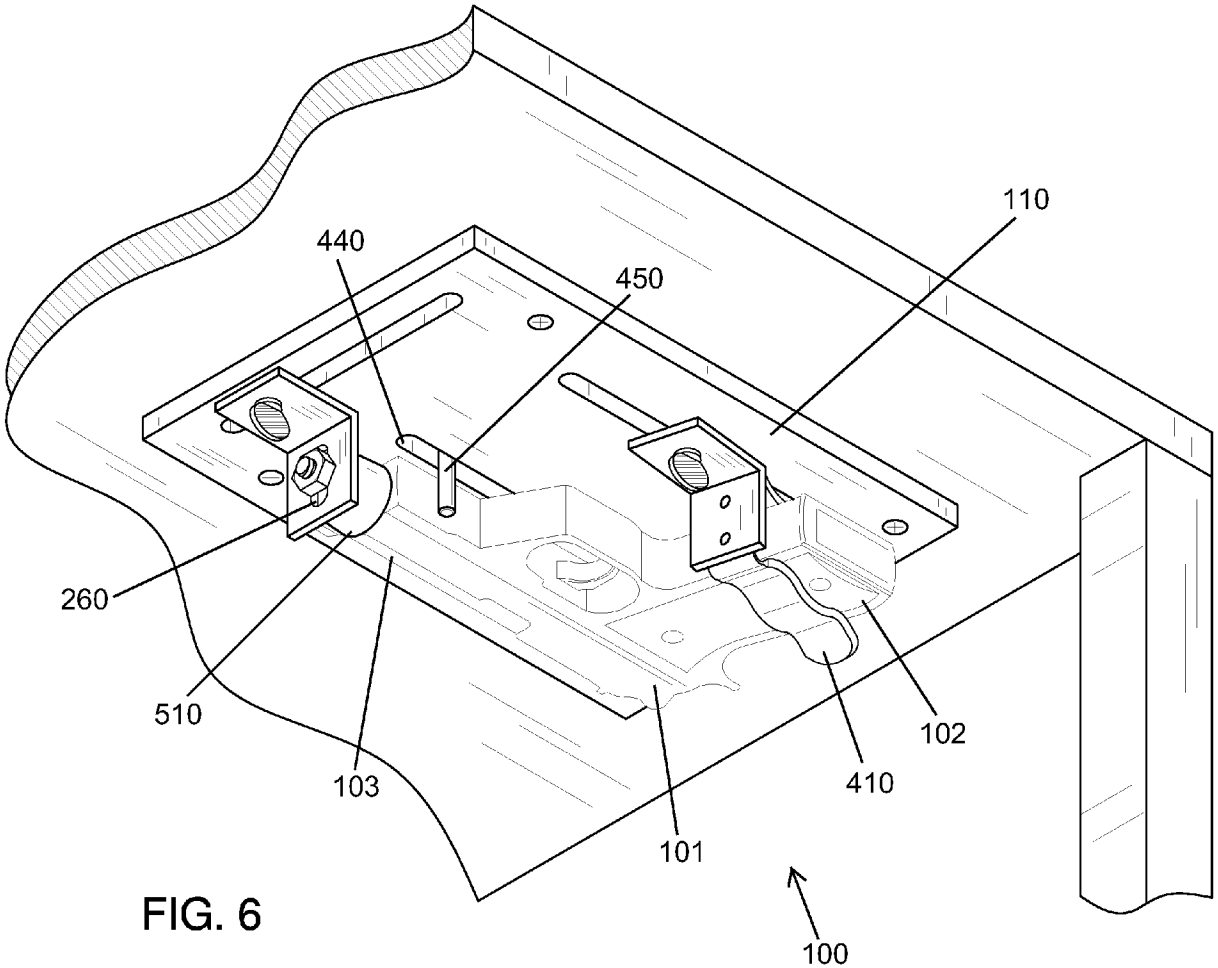
FIG. 6 is an in-use view of the system of FIG. 1.

Referring now to FIG. 1-9, the present invention features a holding system 100 for handguns. The system 100 of the present invention may be installed in a variety of locations such as under a counter, under or in a desk, in a drawer, or the like. FIG. 6 shows the system 100 mounted under a table. The system 100 can provide quick and easy access to a hidden firearm (e.g., handgun 101). Generally, the system 100 allows for obtaining of the firearm (e.g., handgun 101) without the need to release latches or disengage other encumbrances.

The system 100 of the present invention comprises a base plate 110. The base plate 110 may be generally flat. The base plate 110 has a top surface 115 and a bottom surface 116. In some embodiments, the base plate 110 has a first side edge 111, a second side edge 112 adjacent to the first side edge 111, a third side edge 113 (opposite the first side edge 111), and a fourth side edge 114. The base plate 110 may be constructed in a variety of shapes (e.g., rectangular, oval, circular, etc.). The base plate 110 may be constructed from a variety of materials. In some embodiments, the base plate 110 is constructed from a material comprising metal (e.g., aluminum), a plastic (e.g., heavy-duty plastic), the like, or a combination thereof.

The base plate 110 may be constructed in a variety of sizes, for example between about 6 to 8 inches in length as measured from the first side edge 111 to the third side edge 113. In some embodiments, the base 110 is between about 8 to 10 inches in length as measured from the first side edge 111 to the third side edge 113. In some embodiments, the base 110 is more than about 10 inches in length. In some embodiments, the base plate 110 is between about 5 to 7 inches in width as measured from the second side edge 112 to the fourth side edge. In some embodiments, the base plate 110 is between about 7 to 9 inches in width as measured from the second side edge 112 to the fourth side edge. In some embodiments, the base plate 110 is more than about 9 inches in width.

Figure 1:
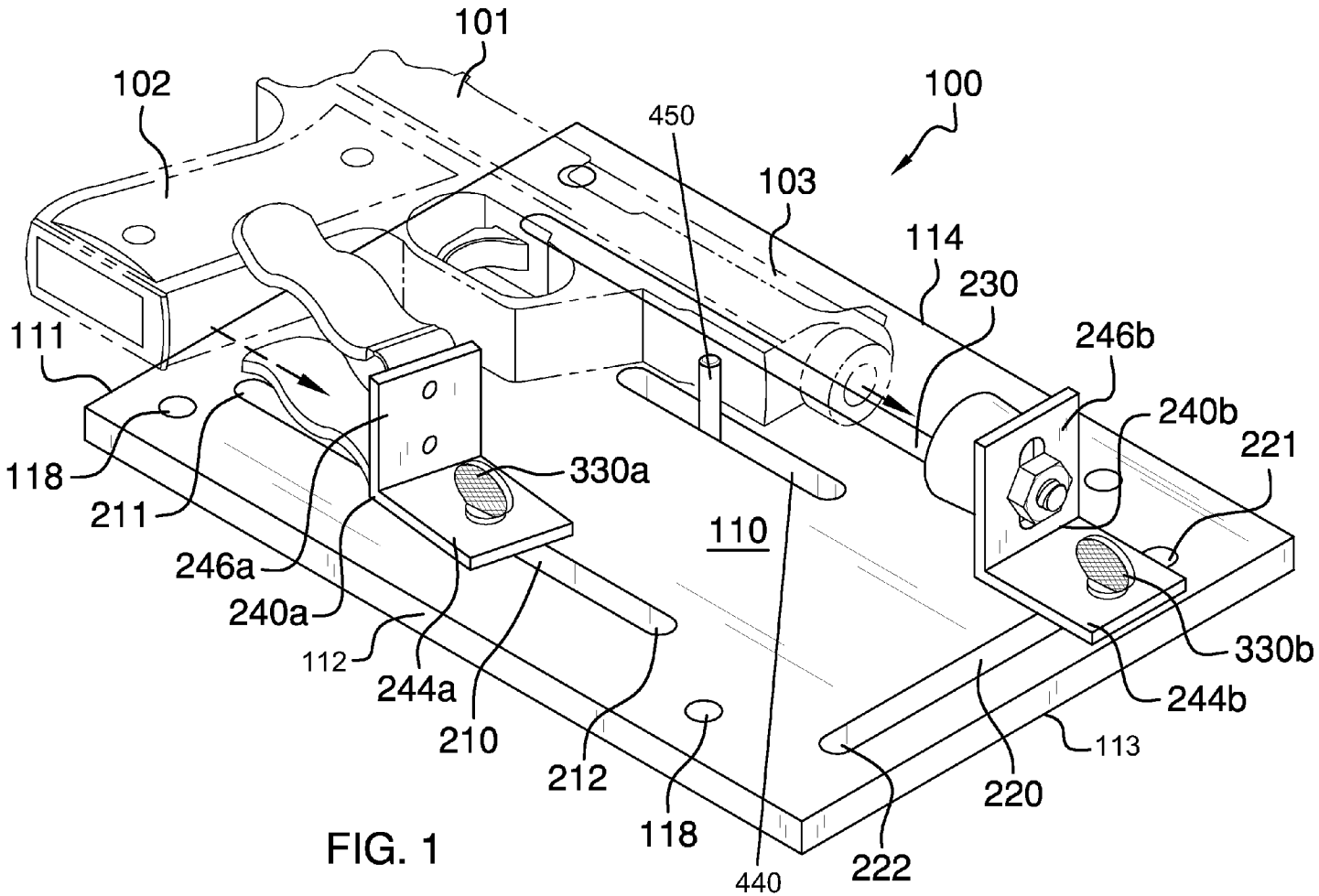
FIG. 1 is a perspective view of the system of the present invention.
Figure 2:
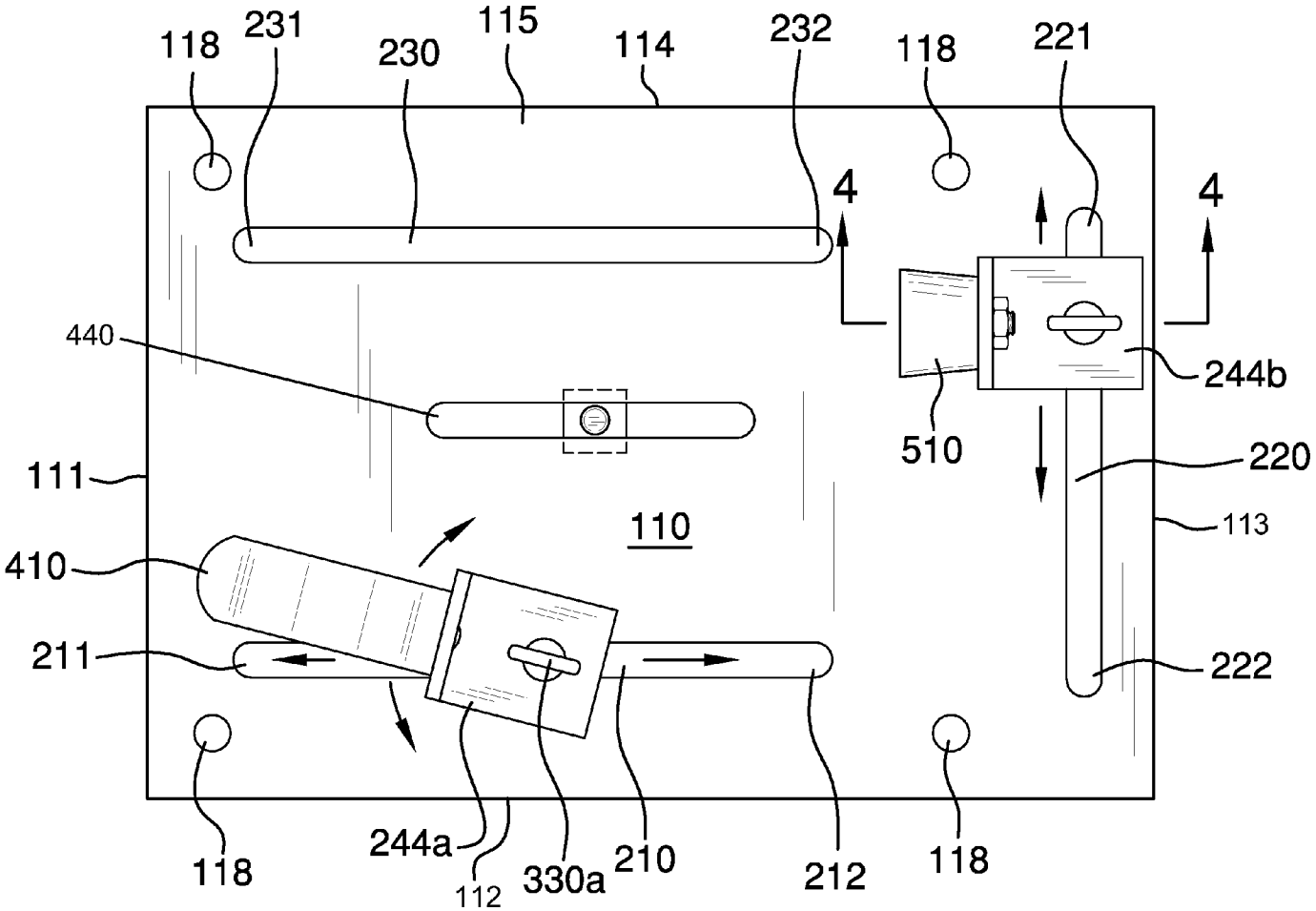
FIG. 2 is a top view of the system of FIG. 1.
Figure 3:
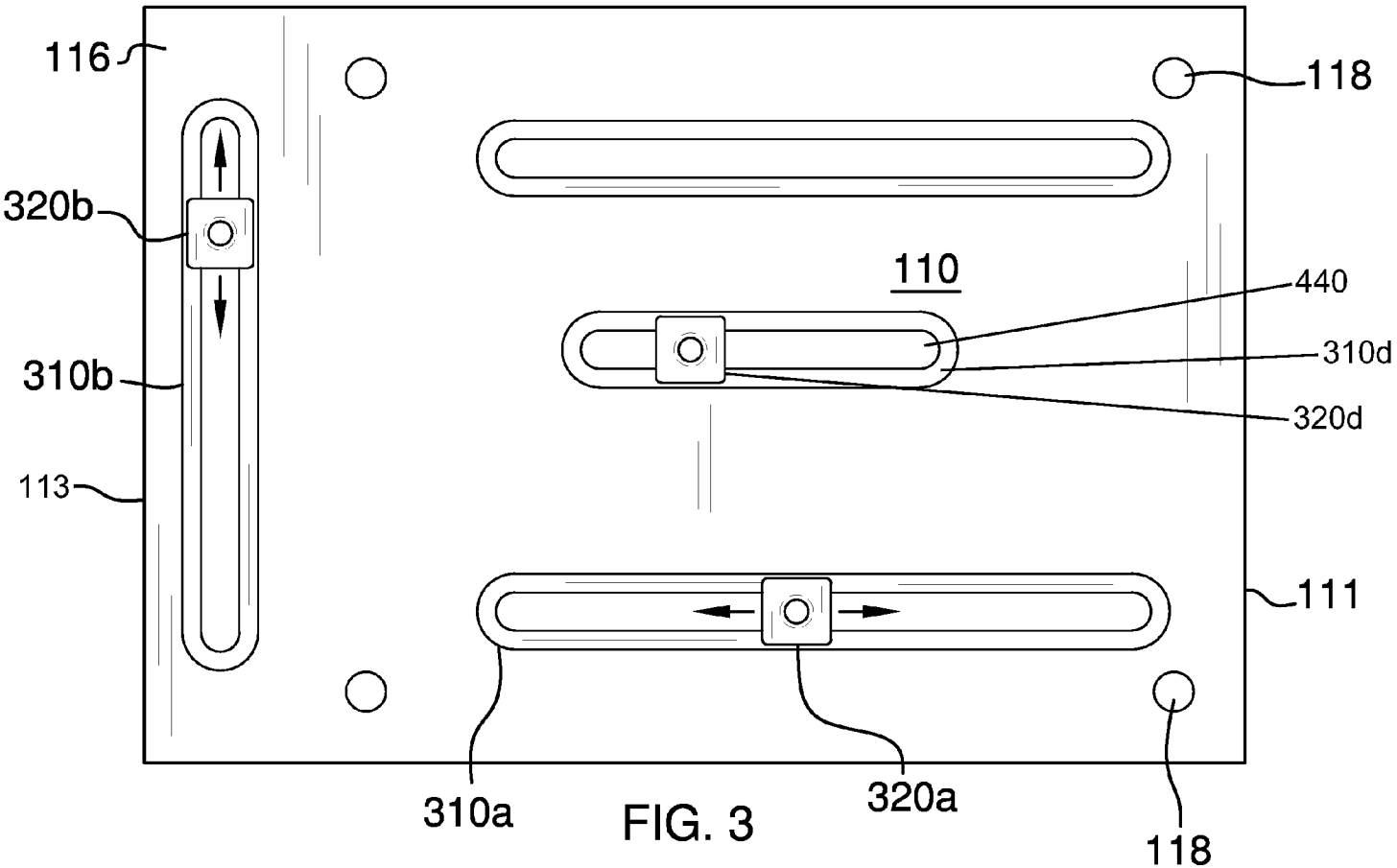
FIG. 3 is a bottom view of the system of FIG. 1.

The base plate 110 can be mounted to a surface, including but not limited to a counter, a desk, a drawer, etc., via a mounting means. In some embodiments, the mounting means comprises one or more mounting apertures 118 disposed in the base plate 110. As shown in FIG. 1-3, mounting apertures 118 are disposed in the base plate 110, for example four mounting apertures 118 are disposed in the base plate 110 near the corners of the base plate 110. The placement of the mounting apertures 118 is not limited to the corners. The mounting apertures 118 allow the base plate 110 to be mounted to a surface via screws, bolts, nails, the like, or a combination thereof. The mounting means is not limited to mounting apertures 118. For example, in some embodiments, the mounting means is an adhesive mechanism, a bracket mechanism, a tie mechanism, a snap mechanism, a hook-and-loop fastener mechanism, a magnet mechanism, the like, or a combination thereof.

A first slot 210 is disposed in the base plate 110. The first slot 210 has a first end 211 and a second end 212. In some embodiments, the first slot 210 extends along the second side edge 112 of the base plate 110 (e.g., from the first side edge 111 of the base plate 110, or near the first side edge 111, to near the third side edge 113). In some embodiments, the first end 211 of the first slot 210 is positioned near the intersection of the first side edge 111 and the second side edge 112 of the base plate 110.

A second slot 220 is disposed in the base plate 110. The second slot 220 has a first end 221 and a second end 222. In some embodiments, the second slot 220 extends along the third side edge 113 of the base plate 110 (e.g., from the second side edge 112, or near the second side edge 112, to near the fourth side edge 114). In some embodiments, the first end 221 of the second slot 220 is positioned near the intersection of the third side edge 113 and the fourth side edge 114 of the base plate 110.

In some embodiments, the first slot 210 and the second slot 220 are positioned along adjacent sides of the base plate 110. However, the slots 210, 220 need not be exactly aligned along the side edges of the base plate 110. The term "positioned along adjacent sides of the base plate 110" refers to the positioning of the two slots relative to each other (e.g., as shown in FIG. 1 and as described herein), not to the edges of the base plate 110.

In some embodiments, a third slot 230 is disposed in the base plate 110. The third slot 230 has a first end 231 and a second end 232. In some embodiments, the third slot 230 extends along the fourth side edge 114 of the base plate 110 (e.g., from the first side edge 111, or near the first side edge 111, to near the third side edge 113), for example as shown in FIG. 2 and FIG. 3. The third slot 230 may be used as an alternative to the first slot 210, for example for a left-handed user or if the user prefers that configuration.

In some embodiments, the first slot 210 is perpendicular to the second slot 220. In some embodiments, the third slot 230 is perpendicular to the second slot 220. In some embodiments, the first slot 210 is parallel to the third slot 230. The present invention is not limited to this configuration. For example, in some embodiments, the angle formed between the first slot 210 and the second slot 220 is between about 45 to 135 degrees. In some embodiments, the angle formed between the third slot 230 and the second slot 220 is between about 45 to 135 degrees. In some embodiments, the angle formed between the first slot 210 and the second slot 220 is between about 65 to 115 degrees. In some embodiments, the angle formed between the third slot 230 and the second slot 220 is between about 65 to 115 degrees. In some embodiments, the angle formed between the first slot 210 and the second slot 220 is between about 80 to 100 degrees. In some embodiments, the angle formed between the third slot 230 and the second slot 220 is between about 80 to 100 degrees. In some embodiments, the angle formed between the first slot 210 and the second slot 220 is between about 85 to 95 degrees. In some embodiments, the angle formed between the third slot 230 and the second slot 220 is between about 85 to 95 degrees.

The system 100 further comprises brackets 240 (e.g., two brackets) for engaging the handgun 101. A first bracket **240*a* is slidably disposed in the first slot 210 (and extends upwardly from the top surface 115 of the base plate 110). In some embodiments, the first bracket 240*a* is slidably disposed in the third slot 230. A second bracket 240*b* is slidably disposed in the second slot 220 (and extends upwardly from the top surface 115 of the base plate 110). The slots 210, 220, 230 allow the brackets 240*a*, 240*b* to be moved and positioned as needed, which can allow for the adjustment of the brackets 240 to accommodate the sizes of the firearm (handgun 101). The brackets 240 can be secured in a particular position within the respective slot 210, 220, 230** via a securing means. The securing means may include but is not limited to a screw mechanism (as described below), a clamp mechanism, the like, or a combination thereof.

The brackets 240 comprise a base portion 244 and a gun portion 246, e.g., the first bracket 240*a* comprises a first base portion 244*a* and a first gun portion 246*a* and the second bracket 240*b* comprises a second base portion 244*b* and a second gun portion 246*b*. The base portions 244 of the brackets 240 engage the base plate 110 and the gun portions 246 of the brackets 240 engage the handgun 101. In some embodiments, the brackets 240 are L-shaped, wherein the horizontal portion of the L-shape is the base portion 244 of the bracket 240 and the vertical portion of the L-shape is the gun portion 246 of the bracket 240. In some embodiments, the base portions 244 are generally flush with the top surface 115 of the base plate 110.

In some embodiments, a first thumbscrew aperture for receiving a first thumbscrew 330*a* is disposed in the first base portion 244*a* of the first bracket 240*a*. In some embodiments, the first thumbscrew 330*a* penetrates the first slot 210. In some embodiments, the first thumbscrew 330*a* penetrates the third slot 230. The first thumbscrew 330*a* can slide within the first slot 210 or the third slot 230, sliding the first bracket 240*a* with respect to the base plate 110. The first thumbscrew 330*a* can rotate within the first slot 210 or the third slot 230, rotating the first bracket 240*a* with respect to the base plate 110.

In some embodiments, a second thumbscrew aperture for receiving a second thumbscrew 330*b* is disposed in the second base portion 244*b* of the second bracket 240*b*. The second thumbscrew 330*b* penetrates the second slot 220. The second thumbscrew 330*b* can slide within the second slot 220, sliding the second bracket 240*b* with respect to the base plate 110. The second thumbscrew 330*b* can rotate within the second slot 220, rotating the second bracket 240*b* with respect to the base plate 110.

In some embodiments, a first counterbore slot 310*a* is disposed in the bottom surface 116 of the base plate 110 in line with the first slot 210. In some embodiments, a second counterbore slot 310*b* is disposed in the bottom surface 116 of the base plate 110 in line with the second slot 220. In some embodiments, a third counterbore slot 310*c* is disposed in the bottom surface 116 of the base plate 110 in line with the third slot 230. Counterbore slots are well known to one of ordinary skill in the art.

In some embodiments, a first screw lock plate 320*a* is slidably disposed in the first counterbore slot 310*a*. In some embodiments, a second screw lock plate 320*b* is slidably disposed in the second counterbore slot 310*b*. In some embodiments, a third screw lock plate is slidably disposed in the third counterbore slot 310*c*. In some embodiments, the first screw lock plate 320*a* is used in the third counterbore slot 310*c*. Screw lock plates are well known to one of ordinary skill in the art.

In some embodiments, the outer end of the first thumbscrew 330*a* engages the first screw lock plate 320*a* (e.g., in the first counterbore slot 310*a*, in the third counterbore slot 310*c*). The first base portion 244*a* of the first bracket 240*a* and the first screw lock plate 320*a* sandwich a portion of the base plate 110. The first thumbscrew 330*a* can turn in a first direction and a second direction respectively causing the first base portion 244*a* and the first screw lock plate 320*a* to compress and release the base plate 110. When the base plate 110 is compressed between by the first base portion 244*a* of the first bracket 240*a* and the first screw lock plate 320*a*, the first bracket 240 is secured in place with respect to the base plate 110.

In some embodiments, the outer end of the second thumbscrew 330*b* engages the second screw lock plate 320*b* in the second counterbore slot 310*b*. The second base portion 244*b* of the second bracket 240*b* and the second screw lock plate 320*b* sandwich a portion of the base plate 110. The second thumbscrew 330*b* can turn in a first direction and a second direction respectively causing the second base portion 244*b* and the second screw lock plate 320*b* to compress and release the base plate 110. When the base plate 110 is compressed between by the second base portion 244*b* of the second bracket 240*b* and the second screw lock plate 320*b*, the second bracket 240*b* is secured in place with respect to the base plate 110.

In some embodiments, the outer end of the first thumbscrew 330*a* engages the third screw lock plate. The first base portion 244*a* of the first bracket 240*a* and the third screw lock plate sandwich a portion of the base plate 110. The first thumbscrew 330*a* can turn in a first direction and a second direction respectively causing the first base portion 244*a* and the third screw lock plate to compress and release the base plate 110. When the base plate 110 is compressed between by the first base portion 244*a* of the first bracket 240*a* and the third screw lock plate, the first bracket 240 is secured in place with respect to the base plate 110.

The brackets 240 are for engaging the handgun 101. In some embodiments, the first bracket 240*a* is for holding the grip portion 102 of the handgun 101 (see FIG. 1, FIG. 6). In some embodiments, a grip engagement device for temporarily gripping the grip portion 102 of the handgun 101 is disposed on the first gun portion 246*a* of the first bracket 240*a*. In some embodiments, the grip engagement device comprises a spring clip 410 (e.g., a U-shaped spring clip) is disposed on the first gun portion 246*a* of the first bracket 240*a*. The spring clip 410 is adapted to snugly (and temporarily) grip the grip portion 102 of the handgun 101. Spring clips are well known to one of ordinary skill in the art. In some embodiments, the spring clip 410 is attached to the first gun portion 246*a* of the first bracket 240*a* via one or more rivets 415.

Figure 4:
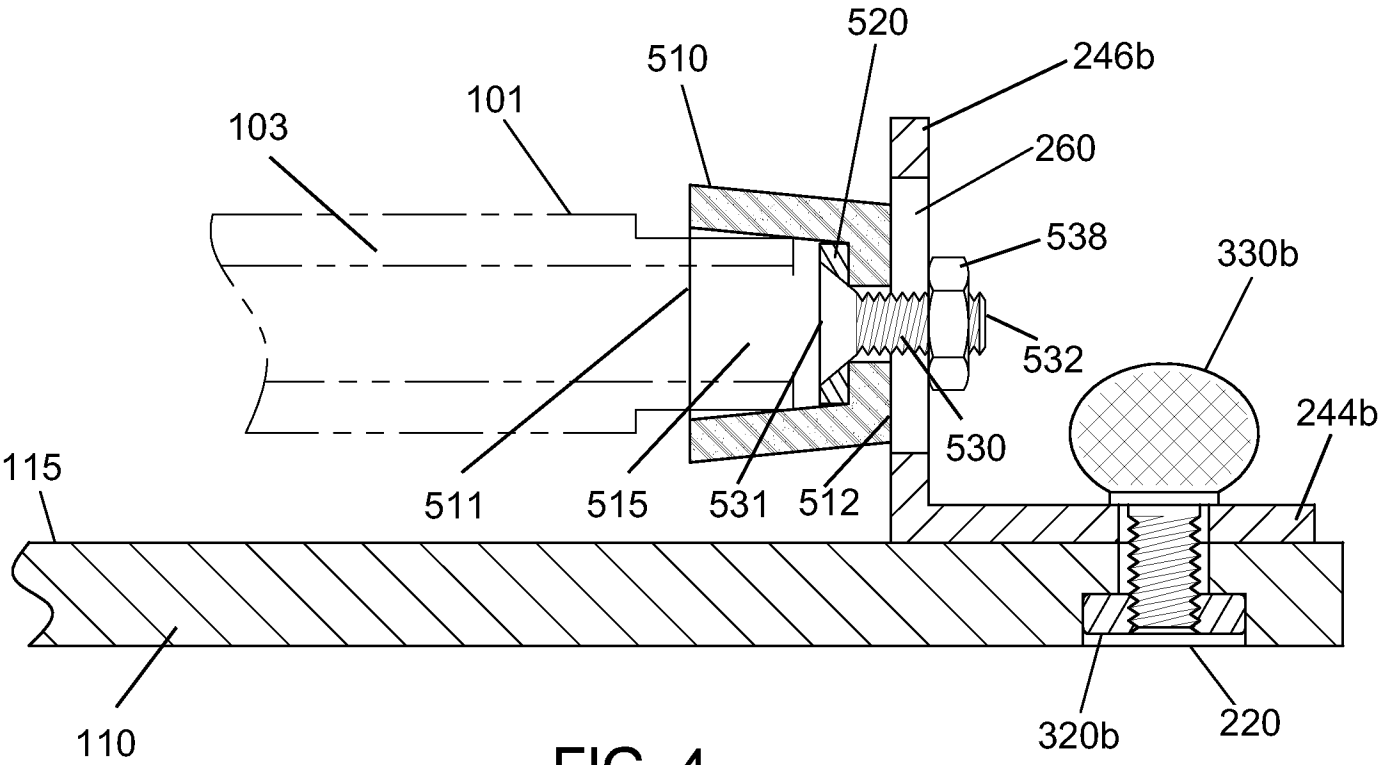
FIG. 4 is a side cross sectional view of the system of FIG. 2.
Figure 5:
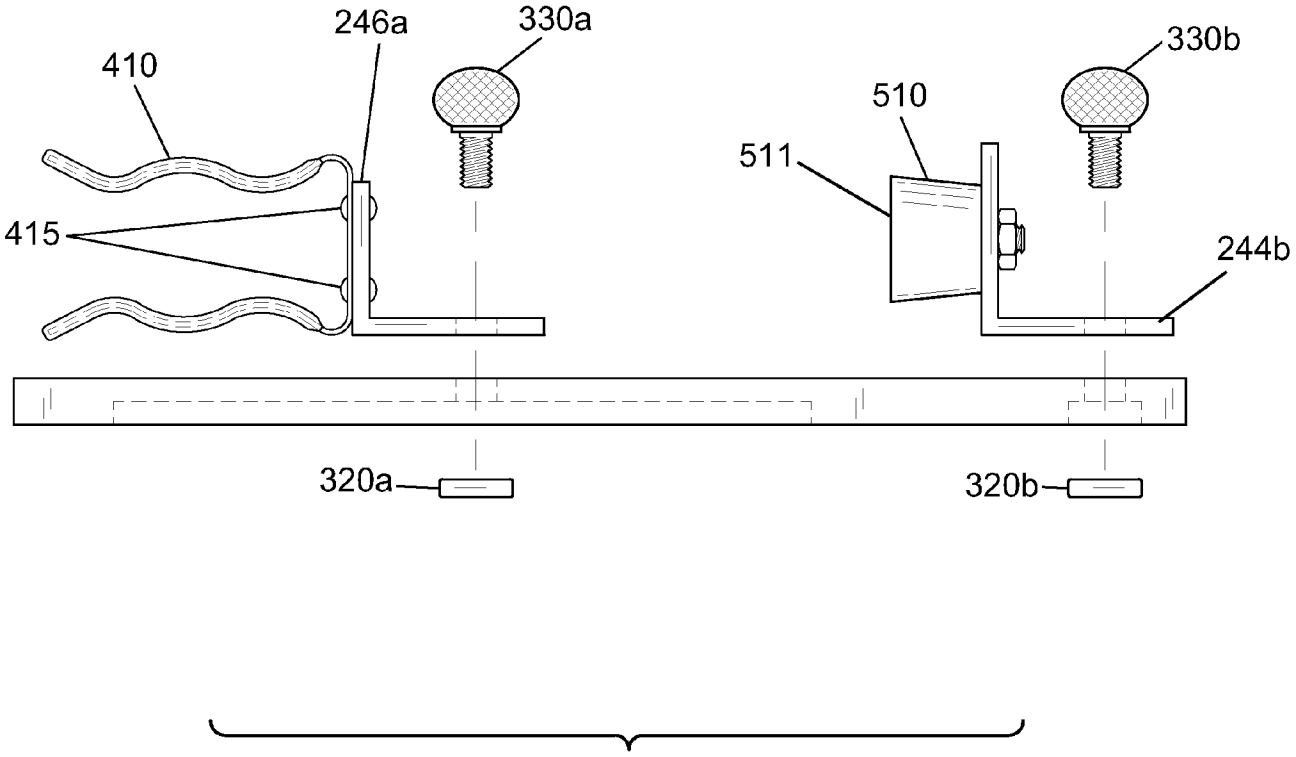
FIG. 5 is an exploded side view of the system of the present invention.

In some embodiments, the second bracket 240*b* is for engaging the barrel 103 of the handgun 101 (see FIG. 1, FIG. 4, FIG. 6, FIG. 7 and FIG. 8). A barrel engagement device is disposed on the second bracket 240*b* (e.g., the second gun portion 246*b*). As shown in FIG. 4, in some embodiments, the barrel engagement device comprises a boot 510, wherein the boot 510 is disposed on the second gun portion 246*b* of the second bracket 240*b*. The boot 510 has an open end 511, a bracket end 512, and an inner cavity 515, wherein the inner cavity 515 is adapted to accept the barrel 103 of the handgun 101. The bracket end 512 engages the second bracket 240*b* (e.g., the second gun portion 246*b* of the second bracket 240*b*). In some embodiments, a boot magnet 520 is disposed on the inner surface of the bracket end 512 of the boot 510. The boot magnet 520 is adapted to temporarily attach to the barrel 103 of the handgun 101 when the barrel 103 is engaged in the inner cavity 515 of the boot 510. Magnet mechanisms are well known to one of ordinary skill in the art.

In some embodiments, the boot 510 is attached to the second gun portion 246*b* of the second bracket 240*b* via an attachment means. In some embodiments, the attachment means comprises a boot screw 530, a bolt, a rivet, welding, the like, or a combination thereof. The attachment means is not limited to the aforementioned means.

In some embodiments, a bracket slot 260 is disposed in the second gun portion 246*b* of the second bracket 246. In some embodiments, a boot screw 530 penetrates the bracket slot 260, the first end 531 of the boot screw 530 engaging the boot 510 and the second end 532 of the boot screw 530 engaging a nut 538. The boot screw 530 can slide and rotate within the bracket slot, allowing the boot 510 to move with respect to the second bracket 240*b* and to move upwardly and downwardly with respect to the top surface 115 of the base plate 110. The nut 538 and the boot 510 sandwich the second gun portion 246*b* of the second bracket 240*b*. The nut 538 or the boot 510 can be rotated to compress or release the second bracket 240*b*. When the second bracket 240*b* is compressed by the nut 530 and the boot 510, the boot 510 is secured in place with respect to the second bracket 240.

In some embodiments, the boot magnet is attached to the first end 531 of the boot screw 530.

Figure 7:
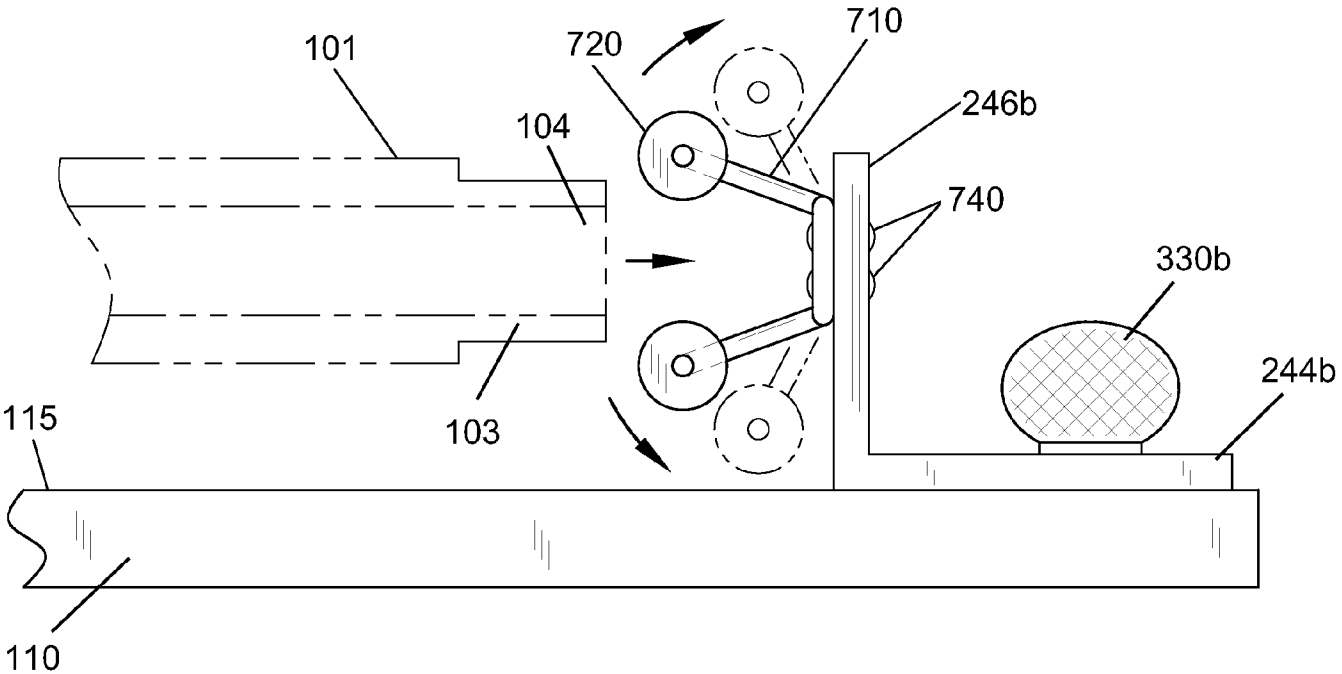
FIG. 7 is a side view of an alternative embodiment of the system of the present invention.

As shown in FIG. 7, in some embodiments, the barrel engagement device comprises a pair of spring arms 710 pivotally attached to the second gun portion 246*b* of the second bracket 240*b*. The spring arms 710 are adapted to snugly hug (e.g., sandwich) the barrel 103 of the handgun 101. The spring arms 710 can move between at least an engaged position and a disengaged position, wherein in the engaged position the spring arms 710 hug the barrel 103 of the handgun 101 and in the disengaged position the spring arms 710 are pivoted away from the barrel 103 of the handgun 101 (e.g., see movement of the spring arms 710 in FIG. 7). In some embodiments, the spring arms 710 may be secured to the second bracket 240*b* via rivets 740. In some embodiments, a roller 720 is disposed on the outer end of each spring arm 710.

Figure 8:
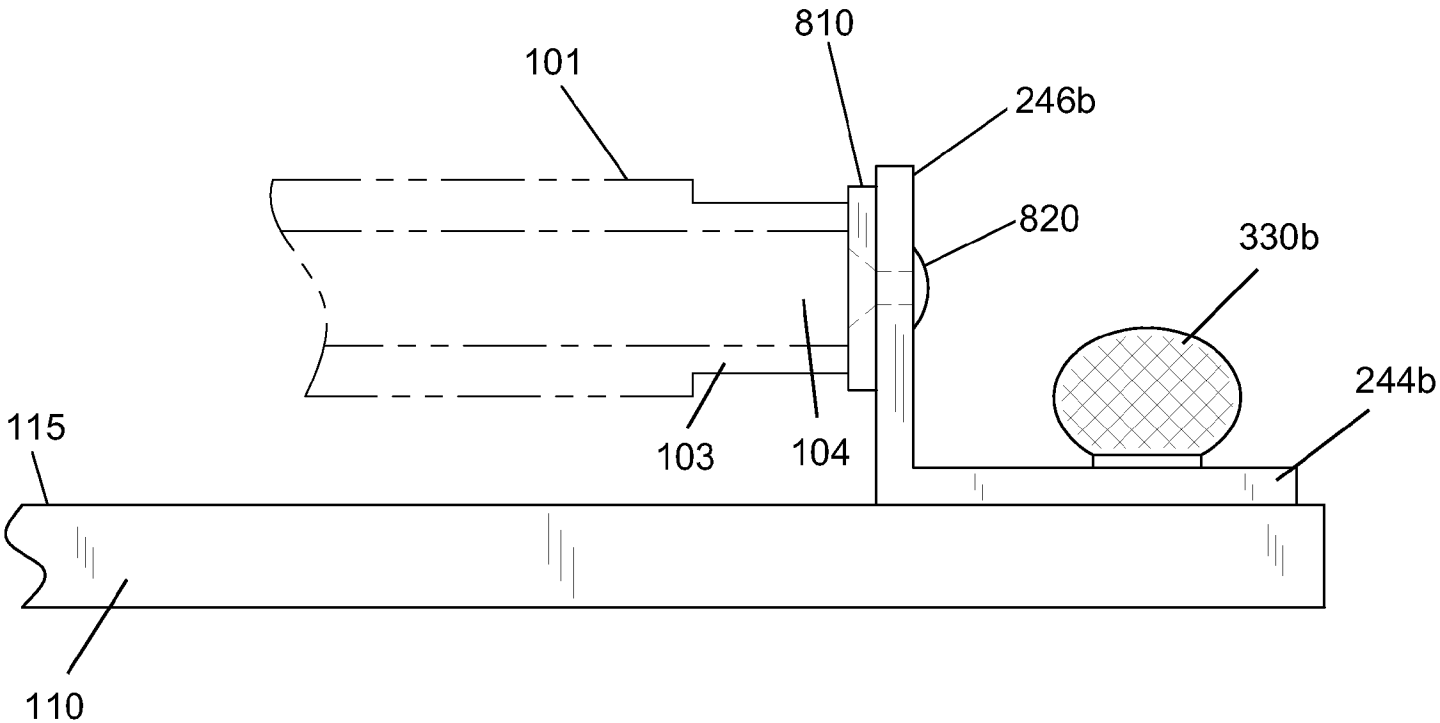
FIG. 8 is a side view of an alternative embodiment of the system of the present invention.
Figure 9:
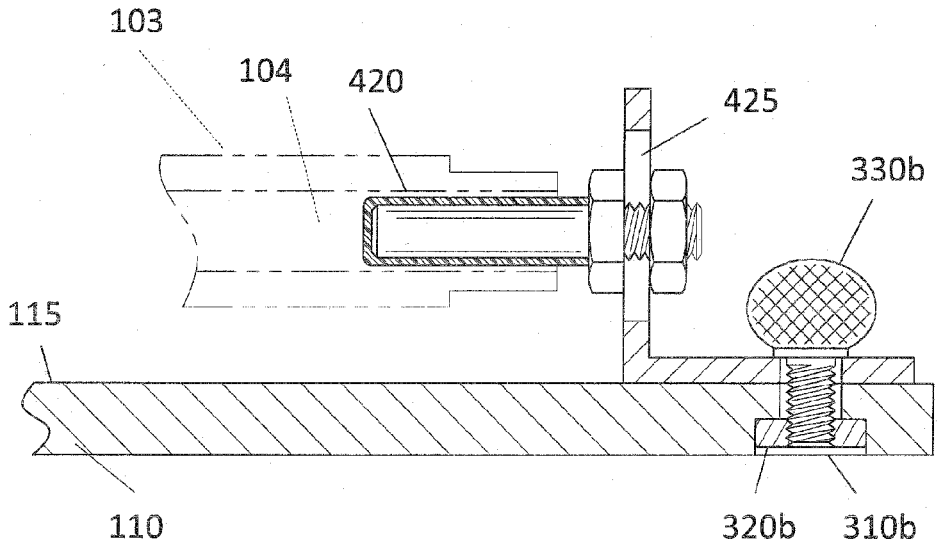
FIG. 9 is a side cross sectional view of an alternative embodiment of the system of the present invention.

As shown in FIG. 8, in some embodiments, the barrel engagement device comprises a barrel magnet 810 disposed on the second gun portion 246*b* of the second bracket 240. In some embodiments, the barrel magnet 810 may be attached to the second gun portion 246*b* via a rivet 820.

In some embodiments, the barrel engagement device comprises a stud 420 disposed on the second gun portion 246*b* of the second bracket 240, wherein the stud 420 engages the inner channel 104 of the barrel 103 of the handgun 101. In some embodiments, the stud 420 is cylindrical. In some embodiments, the stud 420 is sized slightly smaller than the inner channel 104 of the barrel 103 of the handgun 101 so that a snug fit can be achieved. The stud 420 may be removably attached or mounted to the second gun portion 246*b* of the second bracket 240*b*. In some embodiments, the stud 420 is removably mounted in a stud slot 425 disposed in the second gun portion 246*b* of the second bracket 240*b*. Removability may allow a user to attach a more appropriately sized stud 420 for his/her sized handgun 101.

The brackets 240 and/or spring clip 410 and/or boot 510 and/or rollers 720 and/or spring arms 710 may be coated with a material to help prevent the scratching and/or marring of the handgun 101. In some embodiments, the brackets 240 and/or spring clip 410 and/or boot 510 and/or rollers 720 and/or spring arms 710 are coated with a material comprising vinyl, rubber, or other soft surface grip. In some embodiments, the boot 510 is constructed from a material comprising rubber.

In some embodiments, the system further comprises a fourth slot 440 disposed in the base plate 110 in between the first slot 210 and the side edge of the base plate 110 opposite the first slot 210 (e.g., the fourth side edge 114). A fourth counterbore slot 310*d* is disposed in the bottom surface 116 of the base plate in line with the fourth slot 440. A fourth screw lock plate 320*d* is slidably disposed in the fourth counterbore slot 310*d*. The outer end of a guide pin 450 engages the fourth screw lock plate 320*d* and the top end of the guide pin 450 extends upwardly from the top surface 115 of the base plate 110. The guide pin 450 functions to help funnel the barrel 103 of the handgun 101 into the boot magnet, for example.

In some embodiments, the fourth slot 440 is parallel to the first slot 210. In some embodiments the fourth slot 440 is parallel to the third slot 230. In some embodiments, the fourth slot 440 is perpendicular to the second slot 210. In some embodiments, the angle formed between the fourth slot 440 and the second slot 220 is between about 45 to 135 degrees. In some embodiments, the angle formed between the fourth slot 440 and the second slot 220 is between about 65 to 115 degrees. In some embodiments, the angle formed between the fourth slot 440 and the second slot 220 is between about 80 to 100 degrees. In some embodiments, the angle formed between the fourth slot 440 and the second slot 220 is between about 85 to 95 degrees.

As used herein, the term "about" refers to plus or minus 10% of the referenced number. For example, an embodiment wherein the base plate 110 is about 10 inches in length includes a base plate that is between 9 and 11 inches in length.

The disclosures of the following U.S. patents are incorporated in their entirety by reference herein: U.S. Pat. No. 3,796,358; U.S. Pat. No. 6,843,081; U.S. Pat. No. 5,451,023; U.S. Pat. No. 5,467,909; U.S. Pat. No. 3,419,728.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A system (100) comprising:

(a) a base plate (110) having a top surface (115) and a bottom surface (116);

(b) a first slot (210) and a second slot (220) each disposed in the base plate (110), the first slot (210) and the second slot (220) being positioned along adjacent sides of the base plate (110);

(c) a first bracket (240*a*) extending upwardly from the top surface (115) of the base plate (110), the first bracket (240*a*) comprises a first base portion (244*a*) that engages the base plate (110) and a first gun portion (246*a*);

(d) a second bracket (240*b*) extending upwardly from the top surface (115) of the base plate (110), the second bracket (240*b*) comprises a second base portion (244*b*) that engages the base plate (110) and a second gun portion (246*b*);

(e) a first thumbscrew (330*a*) penetrating the first base portion (244*a*) of the first bracket (240*a*) and penetrating the first slot (210), the first thumbscrew (330*a*) can slide and rotate within the first slot (210) to move and rotate the first bracket (240*a*) with respect to the base plate (110);

(f) a second thumbscrew (330*b*) penetrating the second base portion (244*b*) of the second bracket (240*b*) and penetrating the second slot (220), the second thumbscrew (330*b*) can slide and rotate within the second slot (220) to move and rotate the second bracket (240*b*) with respect to the base plate (110);

(g) a first counterbore slot (310*a*) disposed in the bottom surface (116) of the base plate (110) in line with the first slot (210) and a second counterbore slot (310*b*) disposed in the bottom surface (116) of the base plate (110) in line with the second slot (220);

(h) a first screw lock plate (320*a*) slidably disposed in the first counterbore slot (310*a*), and a second screw lock plate (320*b*) slidably disposed in the second counterbore slot (310*b*), wherein an outer end of the first thumbscrew (330*a*) engages the first screw lock plate (320*a*) and an outer end of the second thumbscrew (330*b*) engages the second screw lock plate (320*b*), the first thumbscrew (330*a*) and the second thumbscrew (330*b*) can be rotated in a first direction or a second direction to respectively allow and prevent movement or rotation of the first bracket (240*a*) and second bracket (240*b*), respectively;

(i) a grip engagement device for temporarily gripping a grip portion (102) of a handgun (101), the grip engagement device is disposed on the first gun portion (246*a*) of the first bracket (240*a*);

(j) a barrel engagement device for temporarily engaging a barrel (103) of a handgun (101), the barrel engagement device is disposed on the second gun portion (246*b*) of the second bracket (240*b*), wherein the barrel engagement device comprises a barrel magnet (810) disposed on the second gun portion (246*b*) of the second bracket (240*b*); and (k) a fourth slot (440) disposed in the base plate (110) in between the first slot (210) and a side edge of the base plate (110) opposite the first slot (210), wherein a fourth counterbore slot (310*d*) is disposed in the bottom surface (116) of the base plate in line with the fourth slot (440), wherein a fourth screw lock plate (320*d*) is slidably disposed in the fourth counterbore slot (310*d*), wherein an outer end of a guide pin (450) engages the fourth screw lock plate (320*d*) and a top end of the guide pin (450) extends upwardly from the top surface (115) of the base plate (110).

* * * * *